US005673827A

United States Patent [19]

Lamberti

[11] Patent Number: 5,673,827

[45] Date of Patent: Oct. 7, 1997

[54] SELF-SUPPORTING FOLDABLE PORTABLE DRESSING AREA

[76] Inventor: John Lamberti, 6 Wilsonview Pl., Staten Island, N.Y. 10304

[21] Appl. No.: 719,405

[22] Filed: Sep. 24, 1996

[51] Int. Cl.[6] ..... A41H 5/00; A47G 5/00; E04B 1/346

[52] U.S. Cl. ..... 223/120; 160/351; 160/127; 52/71

[58] Field of Search ..... 223/120, 1; 160/351, 160/127; 52/70, 71

[56] References Cited

U.S. PATENT DOCUMENTS

| | | | |
|---|---|---|---|
| 710,009 | 9/1902 | Robertson . | |
| 1,804,069 | 5/1931 | Stover . | |
| 2,445,164 | 7/1948 | Worthman | 160/127 |
| 2,460,978 | 2/1949 | Derman | 160/127 |
| 2,498,866 | 2/1950 | Suhajda | 223/120 |
| 3,010,225 | 11/1961 | Hale | 35/56 |
| 3,126,237 | 3/1964 | Kirk | 312/204 |
| 3,224,489 | 12/1965 | Haberthier | 160/351 |
| 3,651,851 | 3/1972 | Curtis | 160/351 |
| 4,134,479 | 1/1979 | Crider, Jr. | 190/49 |
| 4,148,163 | 4/1979 | Chenin et al. | 52/71 |
| 4,354,583 | 10/1982 | Walker | 190/18 A |
| 4,738,340 | 4/1988 | Crespi | 190/18 A |
| 5,129,491 | 7/1992 | Seidman | 190/18 A |
| 5,209,327 | 5/1993 | Wright et al. | 190/18 A |

FOREIGN PATENT DOCUMENTS

| | | | |
|---|---|---|---|
| 48107 | 7/1981 | France | 160/351 |

*Primary Examiner*—Bibhu Mohanty
*Attorney, Agent, or Firm*—Rando & Peslak

[57] ABSTRACT

What is disclosed is a self-supporting foldable portable apparatus to transport garments and to function as a self-supporting foldable portable dressing area in remote locations where dressing facilities are not available. The apparatus comprises two foldable back sections, connected by a central support, foldable legs attached to the foldable back sections, wheels attached to each of the foldable back sections in combination with an extendible telescoping pole with locking means and a means to support garments, containers or other items.

2 Claims, 5 Drawing Sheets

SELF-SUPPORTING FOLDABLE PORTABLE DRESSING AREA

BACKGROUND OF THE INVENTION

The present invention is directed to the field of garment transportation, storage and self-supporting dressing area. The present invention is directed to a device to transport clothing and act as a self-supporting foldable portable dressing area.

Generally, the currently available devices for transporting and storage of garments comprise a bulky rectangular base with a post extending upward to support an attached garment bag. These devices stand the height of a garment bag and cannot be reduced in size for easy transportation. Other devices include a cart-like apparatus with telescoping handles, wheels and a base to support a suitcase. These devices provide for luggage transportation but not for the hanging of garments or a self-supporting foldable portable dressing area. In the area of clothes stands the present devices consist of a non-foldable non-portable stand which is fixed in height and is not designed to be used in conjunction with travel.

The present invention is directed to a device that solves these problems. The present invention provides a means for transporting garments and unfolds into a stand which would allow the hanging of garments for easy dressing without the need of a wall or an exterior hook or rod. In this way, people, for example performing and/or auditioning dancers, who need to make rapid costume changes have a device which not only assists them in transporting the clothing but functions as a stand to hang garments, containers or other items.

SUMMARY OF THE INVENTION

It is an object of the present invention to provide a self-supporting foldable portable apparatus to transport garments and to function as a self-supporting foldable portable dressing area in remote locations where dressing facilities are not available. The present invention thus comprises two foldable back sections, connected by a central support, foldable legs attached to the foldable back sections, wheels attached to each of the foldable back sections in combination with an extendible telescoping pole with locking means and a means to support garments, containers or other items.

DETAILED DESCRIPTION OF THE INVENTION

Figure 1:
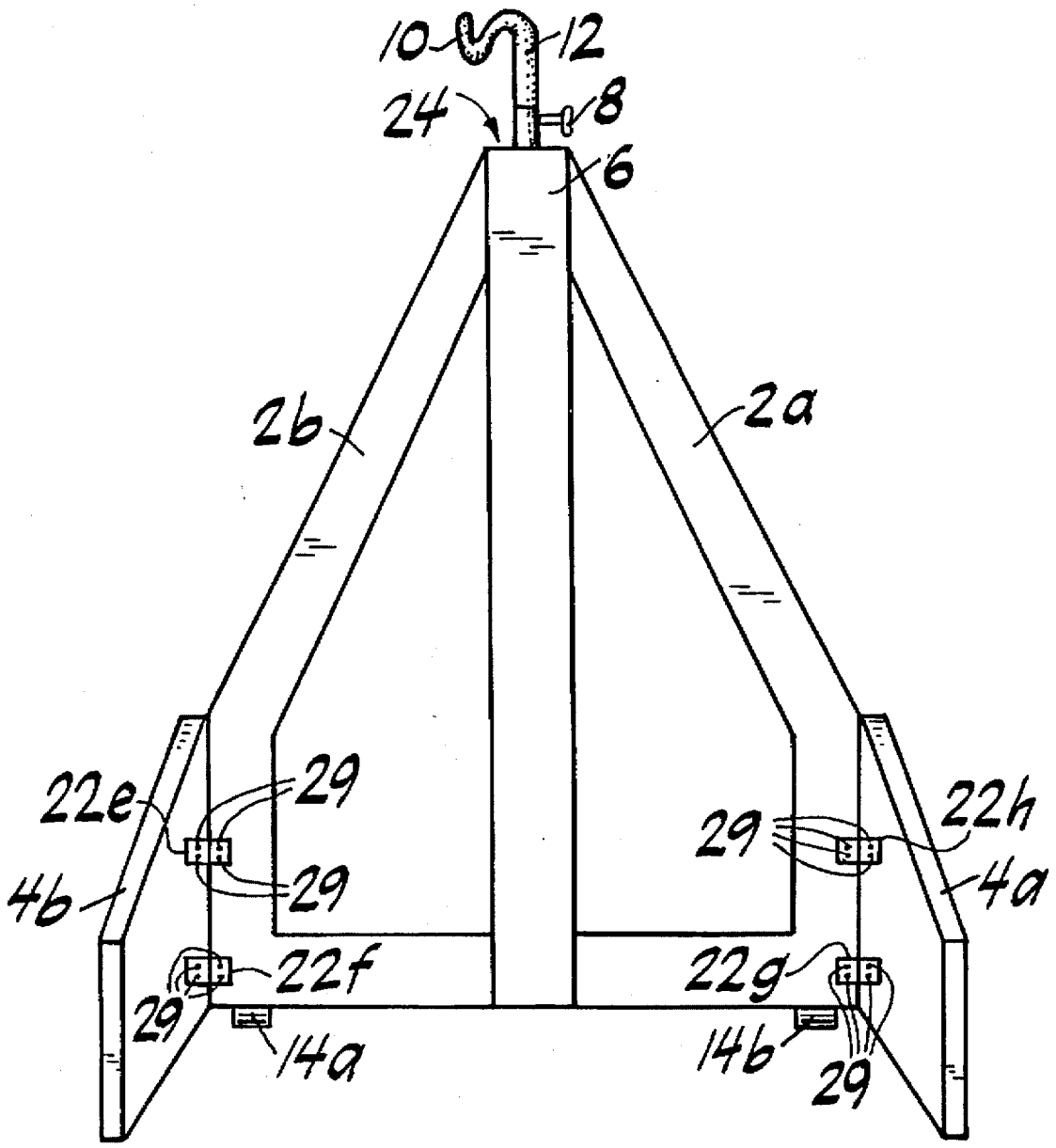
FIG. 1 is a front plan view of a device made in accordance with the present invention in the unfolded position.
Figure 2:
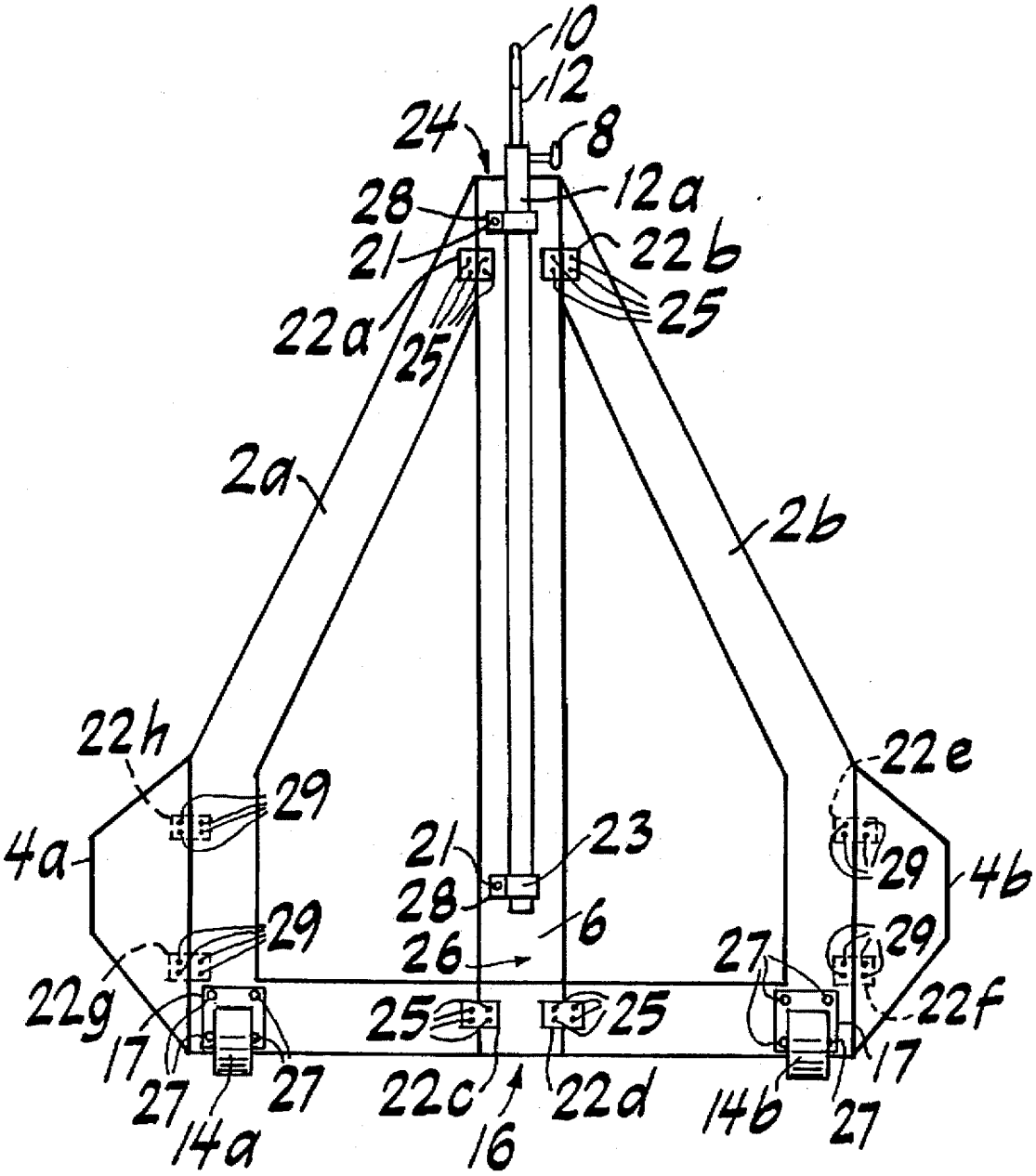
FIG. 2 is a rear plan view of a device made in accordance with the present invention in the unfolded position.

FIGS. 1 and 2 illustrate a self-supporting foldable portable dressing area according to the present invention. The self-supporting foldable portable dressing area comprises a central support 6. In this embodiment, as shown in FIG. 1, the central support 6 is rectangular in shape and extends upward. At the top end 24 of the central support 6 extendible telescoping pole 12 protrudes upward with a means for hanging 10 and means for locking height adjustments 8. As shown in FIG. 2, extendible telescoping pole 12 is encased by a stationary pole 12*a*. Stationary pole 12*a* is fixed to the rear side 26 of central support 6 by U-brackets 28 and screws 21 and 23 or any other suitable means. The means for locking height adjustments 8 is a threaded wing screw pin 8 or any other suitable means as shown in FIGS. 1 and 2. As shown in FIG. 2, near the top end 24 of the central support 6 are two hinges 22*a* and 22*b* symmetrically placed which may be secured by screws 25 or any other suitable means to the rear side 26 of the central support 6. As shown in FIG. 2, the hinge 22*a* extends outward to one side of the central support 6 and hinge 22*b* extends outward to the opposite side of the central support 6. As shown in FIG. 2, near the bottom end 16 of the central support 6 are two hinges 22*c* and 22*d* symmetrically placed which may be secured by screws 25 or any other suitable means to the rear side 26 of the central support 6 and hinge 22*c* extends outward to one side of the central support 6. As shown in FIG. 2, the hinge 22*d* extends outward to the opposite side of the central support 6. Side support 2*a* is fastened by screws 25 or any other suitable means to hinge 22*a* near the top end 24 of the outward side of the central support 6 as shown in FIG. 2. Side support 2*b* is fastened by screws 25 or any other suitable means to hinge 22*b* near the top end 24 of the outward side of the central support 6 as shown in FIG. 2. Side support 2*b* is fastened by screws 25 or any other suitable means to hinge 22*d* near the bottom end 16 of the outward side of the central support 6 as shown in FIG. 2. Side support 2*a* is fastened by screws 25 or any other suitable means to hinge 22*c* near the bottom end 16 of the outward side of the central support 6 as shown in FIG. 2. In this embodiment, side support 2*a* is formed in the shape as shown in FIG. 1. In this embodiment, side support 2*b* is formed in the shape as shown in FIG. 1. As shown in FIG. 2, wheel 14*a* is fastened by screws 27 and a mounting plate 17 or any other suitable means to the rear side 26 toward the outward end of side support 2*a*. Wheel 14*b* is fastened by screws 27 and a mounting plate 17 or any other suitable means to the rear side 26, placed one mounting plate 17 width removed from the opposite and corresponding position of wheel 14*a*, toward the outward end of side support 2*b*. Wheels 14*a* and 14*b* facilitate the moving of the self-supporting foldable portable dressing area.

Figure 3:
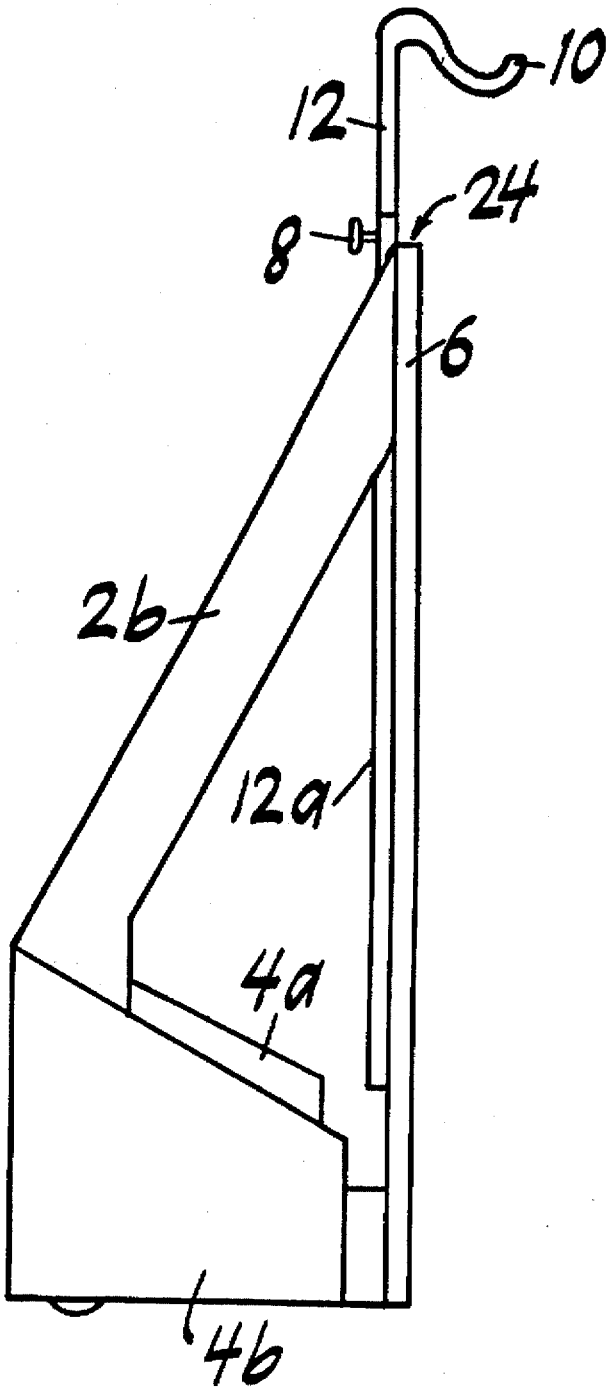
FIG. 3 is a side plan view of a device made in accordance with the present invention in the folded position.

As shown in FIG. 1, recessed locking hinges 22*h* and 22*g* are fastened by screws 29 or any other suitable means, parallel to each other, to the front outward side of side support 2*a*. As shown in FIG. 1, recessed locking hinges 22*e* and 22*f* are fastened by screws 29 or any other suitable means, parallel to each other, to the front outward side of side support 2*b*. In this embodiment, leg 4*b* is formed in the shape as shown in FIGS. 1 and 3, and is fastened by screws 29 or any other suitable means to recessed locking hinges 22*e* and 22*f*. Recessed locking hinges 22*e* and 22*f* are recessed into leg 4*b*. In this embodiment, leg 4*a* is formed in the shape as shown in FIG. 1, and is fastened by screws 29 or any other suitable means to recessed locking hinges 22*h* and 22*g*. Recessed locking hinges 22*g* and 22*h* are recessed into leg 4*a*.

Figure 4:
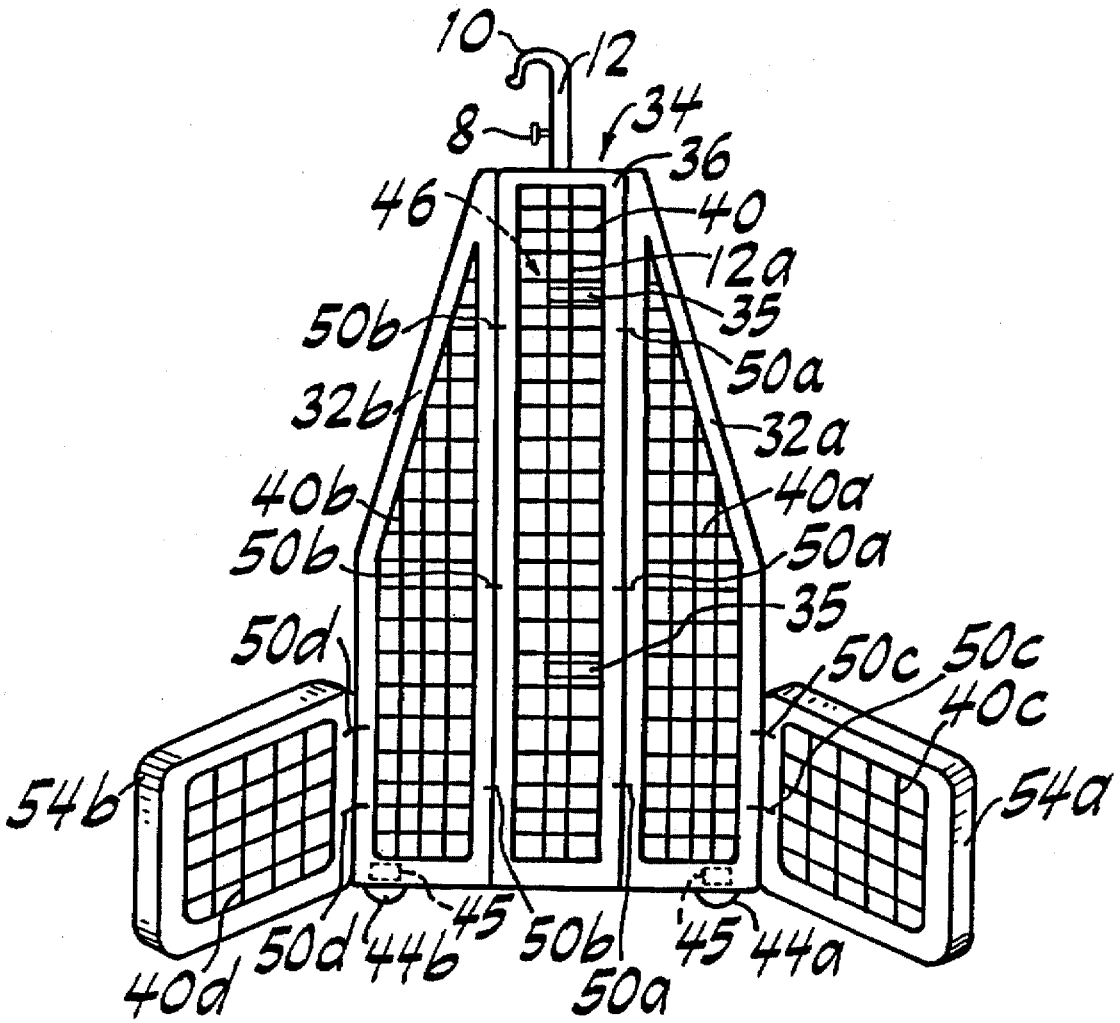
FIG. 4 is a front plan view of a metal embodiment of a device made in accordance with the present invention in the unfolded position.
Figure 5:
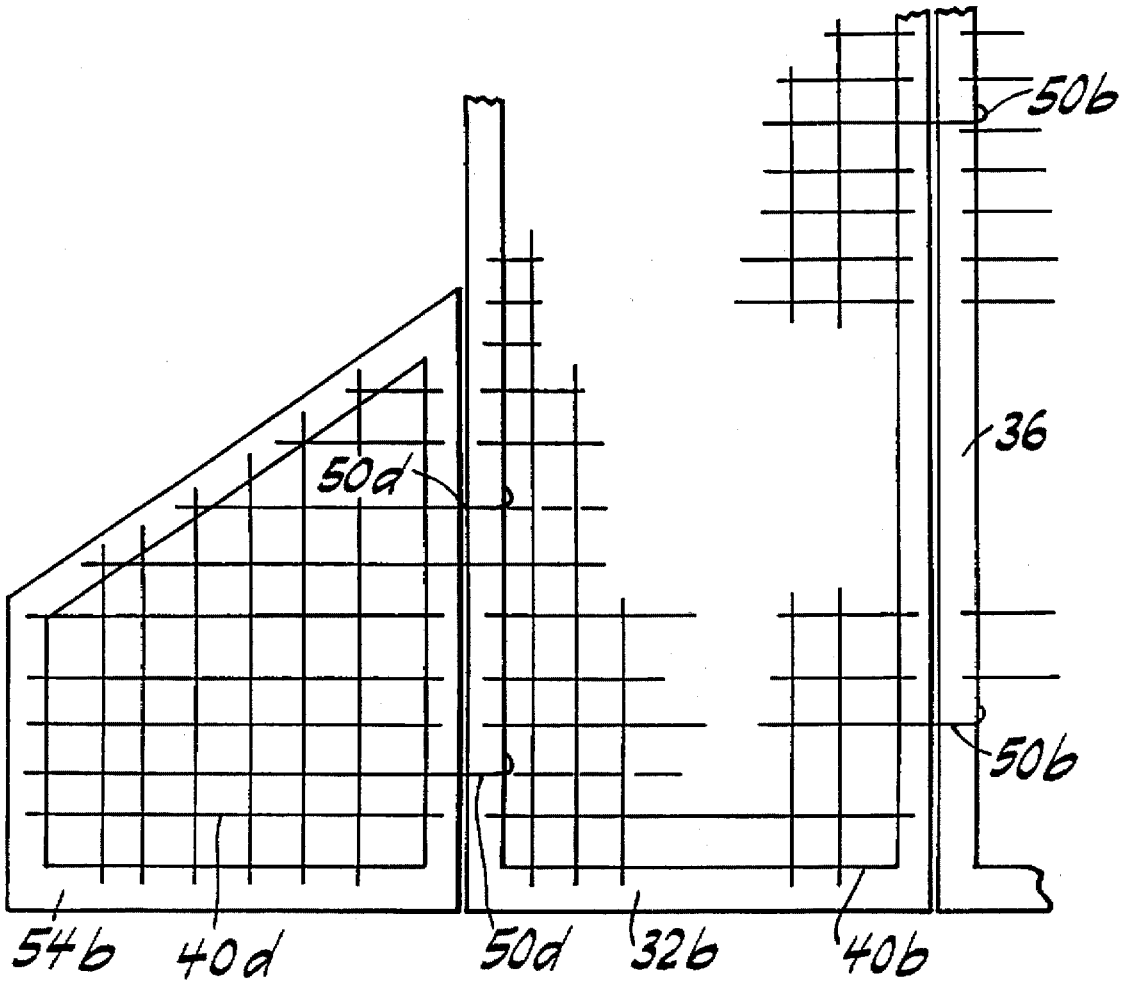
FIG. 5 is an enlarged front view showing the means for attachment of the metal side supports and metal legs.

The device can be constructed of wood, plastic, metal or other suitable material. As seen in FIG. 4, an alternative embodiment, fabricated from metal, of the self-supporting foldable portable dressing area comprises a metal center support 36. In this embodiment the metal central support 36, as shown in FIG. 4, is oblong in shape and is constructed of tubular metal and extends upward. As shown in FIG. 4, mesh 40 comprises a grid-like pattern constructed of metal spokes and is fixed, along the entire length, to metal central support 36 by friction, weld or any other suitable means. At the top end 34 of the metal central support 36 extendible telescoping pole 12 protrudes upward with a means for hanging 10 and means for locking height adjustments 8. As shown in FIG. 4, extendible telescoping pole 12 is encased by a stationary pole 12*a*. Stationary pole 12*a* is fixed to the rear side 46 of metal central support 36 by clamps 35 or any other suitable means. The means for locking height adjustments 8 is a threaded wing screw pin 8 or any other suitable means as shown in FIG. 4. As shown in FIG. 4, metal side support 32*a* is constructed of tubular metal and is formed in the shape as shown in FIG. 4. As shown in FIG. 4, metal side support 32*b* is constructed of tubular metal and is formed in the shape as shown in FIG. 4. As shown in FIG. 4, mesh 40*a* comprises a grid-like pattern constructed of metal spokes and is fixed, along the entire length, to metal side support 32*a* by friction, weld or any other suitable means. As shown in FIG. 4, mesh 40*b* comprises a grid-like pattern constructed of metal spokes and is fixed, along the entire length, to metal side support 32*b* by friction, weld or any other suitable means. As shown in FIG. 4, mesh spokes 50*a* extend beyond the inward side of side support 32*a* and is wrapped around the outward side of the metal central support 36 by folding, twisting, wrapping or any other suitable means. As shown in FIGS. 4 and 5, mesh spokes 50*b* extend beyond the inward side of side support 32*b* and is wrapped around the outward side of the metal central support 36 by folding, twisting, wrapping or any other suitable means. As shown in FIG. 4, wheel 44*a* is fixed by a mounting plate 45 or any other suitable means to the rear side toward the outward end of metal side support 32*a* and mesh 40*a*. As shown in FIG. 4, wheel 44*b* is fixed by a mounting plate 45 or any other suitable means to the rear side, placed one mounting plate width removed from the opposite and corresponding position of wheel 44*a*, toward the outward end of metal side support 32*b* and mesh 40*b*. Wheels 44*a* and 44*b* facilitate the moving of the metal selfsupporting foldable portable dressing area.

In this embodiment, metal leg 54*a* is constructed of tubular metal and is formed in the shape as shown in FIG. 4. In this embodiment metal leg 54*b* is constructed of tubular metal and is formed in the shape as shown in FIG. 4. As shown in FIG. 4, leg mesh 40*c* comprises a grid-like pattern constructed of metal spokes and is fixed along the entire length of metal leg 54*a* by fiction, weld or any other suitable means. As shown in FIG. 4, leg mesh spokes 50*c* extend beyond the inward side of metal leg 54*a* and is wrapped around the outward side of the metal side support 32*a* by folding, twisting, wrapping or any other suitable means. As shown in FIGS. 4 and 5, leg mesh 40*d* comprises a grid-like pattern constructed of metal spokes and is fixed along the entire length of metal leg 54*b* by friction, weld or any other suitable means. As shown in FIGS. 4 and 5, leg mesh spokes 50*d* extends beyond the inward side of metal leg 54*b* and is wrapped around the outward side of the metal side support 32*b* by folding, twisting, wrapping or any other suitable means.

In view of the above, it will be seen that the several objects of the invention are achieved and other advantageous results attained.

As various changes could be made in the above constructions without departing from the scope of the invention, it is intended that all matter contained in the above description as shown in the accompanying drawings shall be interpreted as illustrative and not in a limiting sense.

In practicing the invention, the material used, so long as compatible with the specific use, and the dimensions and contingent shapes, may be any ones meeting occasional requirements.

What is claimed is:

1. A self-supporting foldable portable dressing area comprising:

(a) a central support, which comprises inward, outward, front and rear sides, a top and a bottom;

(b) a plurality of side supports, which comprise outward, inward, front and rear sides, hinged to the rear side of the central support near the top and bottom of the central support and adjacent to each opposite outward side of the central support in the open device position;

(c) a plurality of legs hinged to the opposite outward front sides of the plurality of side supports;

(d) an extendible pole means, which comprises a top and bottom, attached to the rear side of the central support;

(e) a locking means attached to the extendible pole means;

(f) a hook means attached to the top of the extendible pole means;

(g) and a plurality of wheels attached to the rear side of the plurality of side supports near the outward sides.

2. A self-supporting foldable portable dressing area constructed from metal, comprising:

(a) a plurality of metal spokes;

(b) a plurality of meshes which comprise metal spokes;

(c) a central support, which comprises inward, outward, front and rear sides, a top and a bottom and mesh;

(d) a plurality of side supports, which comprise outward, inward, front and rear sides and of meshes and metal spokes wrapped around each opposite side of the central support;

(e) a plurality of legs, which comprise meshes and metal spokes wrapped around each opposite end of the plurality of side supports;

(f) an extendible pole means, which comprises a top and bottom, attached to the rear side of the central support;

(g) a locking means attached to the extendible pole means;

(h) a hook means attached to the top of the extendible pole means;

(i) and a plurality of wheels attached to the rear side of the plurality of side supports near the outward sides.

* * * * *